US009457953B1

(12) United States Patent
Davies

(10) Patent No.: US 9,457,953 B1
(45) Date of Patent: Oct. 4, 2016

(54) PRODUCE BAG WITH SELECTIVE GAS PERMEABILITY

(71) Applicant: United Source Packaging LLC, Vancouver, WA (US)

(72) Inventor: Edward Davies, Pleasanton, CA (US)

(73) Assignee: United Source Packaging LLC, Vancouver, WA (US)

( * ) Notice: Subject to any disclaimer, the term of this patent is extended or adjusted under 35 U.S.C. 154(b) by 0 days.

(21) Appl. No.: 14/956,260

(22) Filed: Dec. 1, 2015

Related U.S. Application Data

(60) Provisional application No. 62/088,559, filed on Dec. 6, 2014.

(51) Int. Cl.
*B65D 33/01* (2006.01)
*B65D 85/34* (2006.01)
*B65D 30/08* (2006.01)

(52) U.S. Cl.
CPC ..... *B65D 85/34* (2013.01); *B65D 31/04* (2013.01); *B65D 33/01* (2013.01)

(58) Field of Classification Search
CPC ..... B56D 33/01; B56D 2565/388
USPC ..... 383/102; 426/118
See application file for complete search history.

(56) References Cited

U.S. PATENT DOCUMENTS 4,734,324 A 3/1988 Hill
4,769,262 A 9/1988 Ferrar et al.
4,830,863 A 5/1989 Jones
4,842,875 A 6/1989 Anderson
4,879,078 A 11/1989 Antoon, Jr.
4,910,032 A 3/1990 Antoon, Jr.
4,923,703 A 5/1990 Antoon, Jr.
5,045,331 A 9/1991 Antoon, Jr.
5,160,768 A 11/1992 Antoon, Jr.
5,254,354 A 10/1993 Stewart
5,901,848 A * 5/1999 Gorlich ..... B65D 81/245 206/439
6,376,032 B1 4/2002 Clarke et al.
6,511,688 B2 1/2003 Edwards et al.
6,548,132 B1 4/2003 Clarke et al.

(Continued)

FOREIGN PATENT DOCUMENTS

EP 0351115 A2 1/1990
EP 0351116 A2 1/1990

OTHER PUBLICATIONS

Bedane et al., "Mass transfer of water vapor, carbon dioxide and oxygen on modified cellulose fiber-based materials," Nordic Pulp and Paper Research Journal V27, Feb. 2012.

(Continued)

*Primary Examiner* — Jes F Pascua
(74) *Attorney, Agent, or Firm* — Silicon Edge Law Group LLP; Arthur J. Behiel

(57) ABSTRACT

Described are gas-permeable bags for storing respiring materials. The bags can be formed using a single sheet of a sturdy, transparent, gas-impermeable material to facilitate the viewing of bag contents. The bags can also include two or more gas-permeable walls with respective and different gas-transmission rates that are selected so that the overall gas-transmission rates for the bags are tailored for their contents. The types of films and laminates used for the gas-permeable walls exhibit gas-transmission rates for oxygen, carbon dioxide, and water that are favorable for different types of respiring materials.

16 Claims, 3 Drawing Sheets

(56) References Cited

U.S. PATENT DOCUMENTS

| | | | | |
|---|---|---|---|---|
| 6,945,392 | B2 * | 9/2005 | Furukawa | B65D 33/01 206/213.1 |
| 7,169,451 | B2 * | 1/2007 | Clarke | B32B 5/18 426/106 |
| 2008/0226775 | A1 | 9/2008 | Forsyth et al. | |
| 2010/0024358 | A1 * | 2/2010 | Meseguer Huertas | B65D 29/00 53/128.1 |
| 2015/0366230 | A1 * | 12/2015 | Malefyt | B32B 3/266 426/323 |

OTHER PUBLICATIONS

Chonhenchob et al, "High Permeable Films Used for Modified Atmosphere Packaging Improve Quality and Shelf Life of Baby Corn," Journal of Applied Packaging Research, V3 Apr. 2009.

"Packaging Fresh Fruit and Vegetables," Danish Technological Institute Packaging and Transport 2008 (26pp).

Larsen et al., "Determination of O2 and CO2 transmission rate of whole packages and single perforations in micro-perforated packages . . . " Journal of Food Engineering 119 (2013).

Maul, "Barrier Enhancement Using Additives," Pira International Conference Brussels, Belgium Dec. 5-6, 2005.

* cited by examiner

PRODUCE BAG WITH SELECTIVE GAS PERMEABILITY

FIELD

This disclosure relates to gas-permeable packages for e.g. storing fresh produce.

BACKGROUND

Respiring biological materials, like fresh fruits and vegetables, consume oxygen ($O_2$) and produce carbon dioxide ($CO_2$). Respiration can be slowed, and freshness extended, by freezing or refrigeration. Unfortunately, maintaining the desired low temperatures is energy intensive and costly, and can adversely affect flavor and appearance. Freshness can also be extended by controlling the relative and absolute concentrations of oxygen and carbon dioxide in the packaging atmosphere surrounding the materials. Too much oxygen results in rapid spoilage, and too little can allows potentially dangerous anaerobic bacteria to thrive.

Controlled atmosphere packaging (CAP) and modified atmosphere packaging (MAP) are technologies that afford some control over the concentrations of oxygen and carbon dioxide. The preferred packaging atmosphere depends on the stored material. For example, broccoli is best stored in an atmosphere containing between one and two percent oxygen and between five and ten percent carbon dioxide, whereas raspberries benefit from a higher concentration of carbon dioxide that delays grey mold decay. There is therefore a need for packaging solutions tailored to their contents.

BRIEF DESCRIPTION OF THE DRAWINGS

The subject matter disclosed is illustrated by way of example, and not by way of limitation, in the figures of the accompanying drawings and in which like reference numerals refer to similar elements and in which.

DETAILED DESCRIPTION

Figure 1:
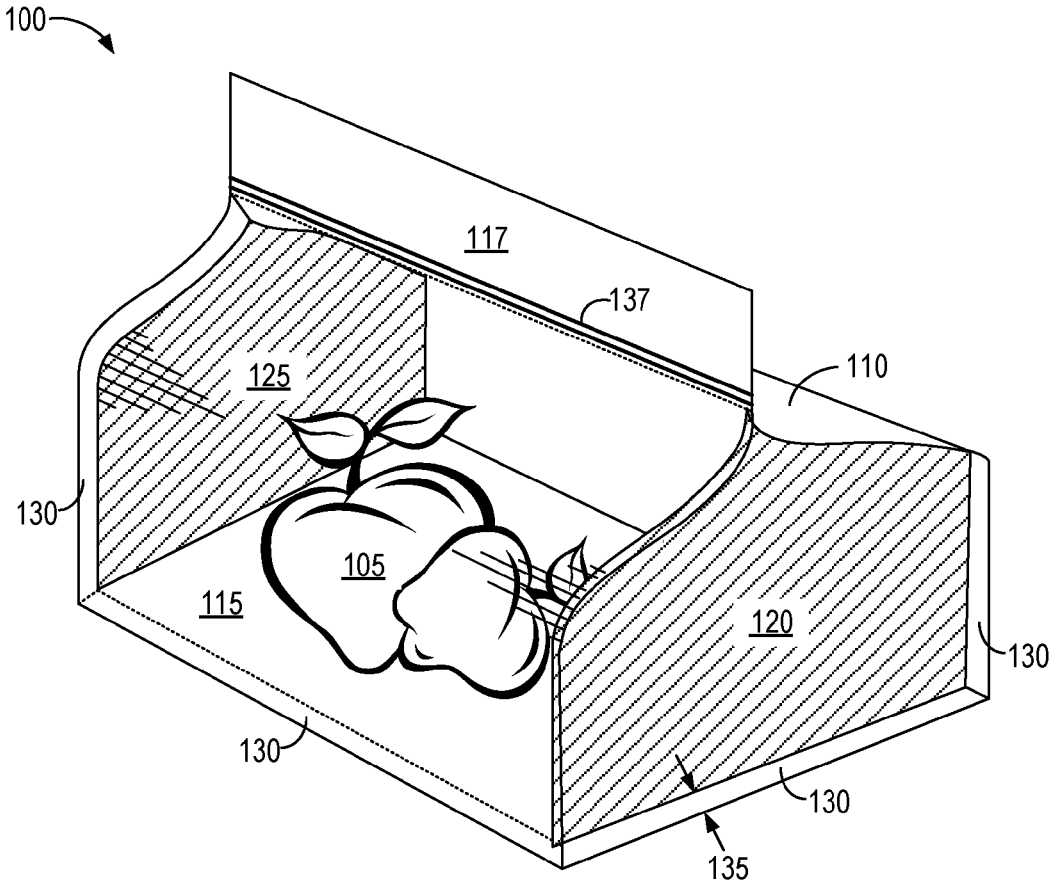
FIG. 1 depicts a gas-permeable bag 100 for storing respiring materials.

FIG. 1 depicts a gas-permeable bag 100 for storing respiring materials, a pair of apples 105 in this example. Bag 100 is formed using a single sheet of a sturdy, transparent, gas-impermeable material that forms a pair of transparent walls 110 and a transparent floor 115. Two gas-permeable side walls 120 and 125 are thermally bonded to walls 110 and floor 115 via seals 130 of a minimum dimension 135 to form a side- and bottom-gusseted pouch. Walls 120 and 125 can have respective and different gas-transmission rates that are selected so that the overall gas-transmission rate for bag 100 is tailored for the contents of bag 100.

Walls 110 and floor 115 are of a clear polymer film or laminate that allows consumers to visibly inspect the bag's contents. In one embodiment, walls 110 and floor 115 are of a haze less than ten. (Haze is a measure of light transmission, with zero and one-hundred haze respectively representing complete transmission and complete opacity.) The interior surfaces of walls 110 can include a coating or surface that inhibits condensation (anti-fog). The ends of walls 110 are sealed along the top 117 after the contents are placed in bag 100. Top 117 can be resealable, using a two-part sliderless zipper 137 for example.

The gas-transmission rates for each of walls 120 and 125 are a function of the transmission rates per unit area and the wall area. For example, the gas-transmission rate for oxygen is a function of the oxygen-transmission rate (OTR) of the material for wall 120, the area of wall 120, the OTR of the material for wall 125, and the area of wall 125. (Gas-transmission rates, including OTR, are specified herein in units of cc/100 $in^2$/24 h.) For a given bag design and size, the two walls 120 and 125 can be of sheets with different OTRs to achieve a desired overall gas-transmission rate for oxygen. Gas-permeable materials can likewise be combined to obtain desired permeabilities for e.g. water and carbon dioxide.

Bag 100 can support sturdy, reliable, and transparent packaging with relatively high package oxygen transmission rates. For example, if an embodiment of bag 100 requires an overall oxygen gas-transmission rate of 2,000, eighty percent of the interior area of package 100 can be transparent films or laminates with very low OTR values (e.g., walls 110 and floor 115 can have an OTR of one hundred), and twenty percent of the interior of bag 100 can be sidewalls 120 and 125 of films or laminates that together provide an OTR of about 10,000. The OTR for the entire package 100 would be about 2,000, the desired value.

Figure 2:
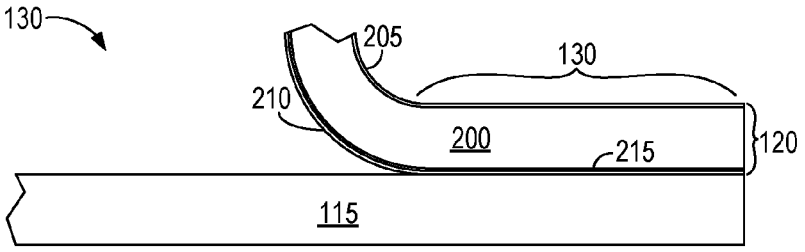
FIG. 2 is a cross-section of a seam 130 of bag 100 of FIG. 1.

FIG. 2 is a cross-section of a seam 130 of bag 100 of FIG. 1. Seam 130 is formed where an edge of a floor 115 is bonded to a corresponding edge of wall 120. Walls 110 and 125 are similarly bonded, as depicted in FIG. 1. As noted previously, floor 115 can be of a clear polymer film or laminate.

The bulk and strength of wall 120 are provided by a porous suspension layer 200 of e.g. paper. The outside of suspension layer 200 (the side away from floor 115) may include e.g. an ink layer 205 for graphics. The gas-transmission rates of suspension layer 200 and ink layer 205 combined are generally much higher than desired for the contents of bag 100. That is, these layers are essentially porous to at least one of oxygen, carbon dioxide, and water.

Suspension layer 200 can be of other materials. For example, bags subjected to wet environments might use a suspension layer of e.g. a non-woven polypropylene or polyethylene. Ink layer 205 can likewise be of various materials, including e.g. of pigmented emulsion coatings.

The inside of layer 200 includes a perforated sealant layer 210 and a gas-permeable membrane 215 that collectively determine the gas-transmission rates (e.g., OTR and carbon-dioxide transmission rate, or CO2TR) of wall 120. The material of sealant layer 210 is relatively impermeable, so the gas-transmission rates of layer 210 are proportional to the collective area of the perforations. Membrane 215 is gas permeable, but much less so than layer 200, so the gas-transmission rates of layer 120 are primarily a function of the permeability of membrane 215 and the collective area of the perforations in sealant layer 210. Sealant layer 210 is of e.g. a non-woven polyethylene or polypropylene with a high percentage of open areas in other embodiments.

Paper used for suspension layer 200 can be machined to provide a smooth surface for thin membrane 215. In this example, membrane 215 doubles as an adhesive to bind sealant layer 210 to suspension layer 200. Sealant layer 210 is also dual purpose, serving both to establish desired gas-transmission rates and to act as a thermal adhesive to bond layers 120 and 115 to form seam 130.

Figure 3:
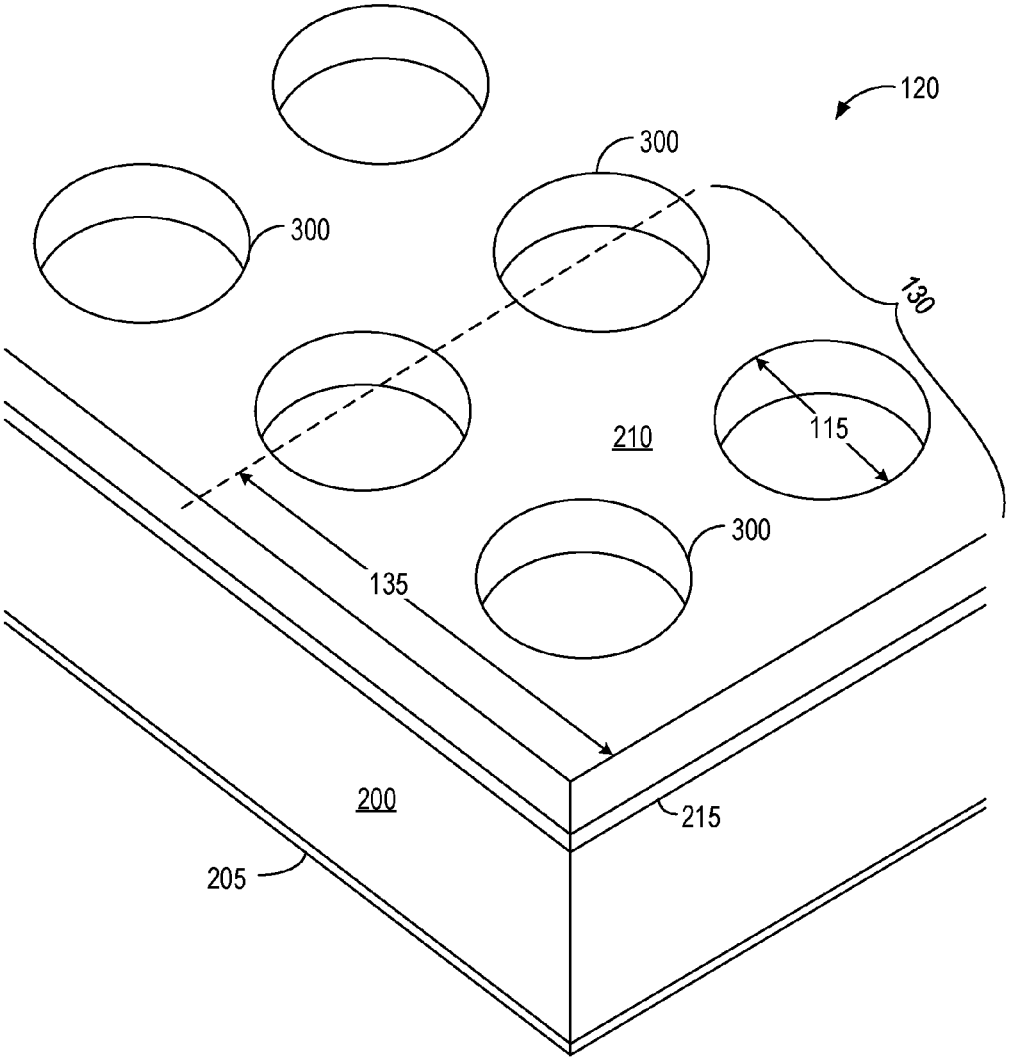
FIG. 3 depicts a section of wall 120 of FIGS. 1 and 2, with outside ink layer 205 at bottom.

FIG. 3 depicts a section of wall 120 of FIGS. 1 and 2, with outside ink layer 205 at bottom. Perforated sealant layer 210 includes holes 300. Sealant layer 210 is of a material that is practically impermeable, but holes 300 expose gas-permeable membrane 215 to allow gases to pass through wall 120. For example, seal layer 210 may be a one-mil sheet of polyethylene or polypropylene, and membrane 215 a 0.1 mil layer of a urethane or isocyanate adhesive. Holes 300 are of a diameter 305 that is less than minimum dimension 135 so that holes 300 do not interfere with the formation of seal 130. Holes 300 can be of different or diverse shapes and patterns in other embodiments.

Suspension layer 200 can be essentially porous, allowing other layers of wall 120 to control gas transmission. In one example, layer 200 is cut from a four-mil sheet of C1S or machine-grade paper. This paper can be machined to provide a smooth surface for thin membrane 215. The roughness of the paper may contribute to gas transmission, and may therefore be selected to achieve desired gas-transmission rates. Ink layer 205 can be continuous or patterned to create desired visual and material properties. Conventional ink layers are emulsion coatings of e.g. lacquer, urethane, etc.

The gas-transmission rates of wall 120 are primarily functions of the combined areas of holes 300 and the gas-transmission rates of membrane 215. The same is true of wall 125 (FIG. 1), but the gas-transmission rates of walls 120 and 125 can be different. Different wall materials can thus be chosen for walls 120 and 125 to tailor bag 100 for its expected contents. For example, for a bag of a given size, walls 120 and 125 can be of relatively low and high OTR layers, respectively, to produce an overall medium gas-transmission rate. The possibility of thus combining wall materials allows greater design flexibly for a given set of standard gas-transmission-rate wall materials. More than two walls, differently sized walls, or portions of walls, can be of this material type in other embodiments to provide still more design flexibility.

Oxygen permeability, or oxygen transmission rate (OTR), and carbon-dioxide permeability, or carbon-dioxide transmission rate (CO2TR), are expressed in terms of $ml/m^2 \cdot atm \cdot 24$ hrs, with the equivalent in $cc/100\ inch^2 \cdot atm \cdot 24$ hrs. The abbreviation R is used to denote the ratio of CO2TR to OTR (i.e., CO2TR/OTR), both permeabilities being measured at 20° C.

A continuous polymeric layer typically has an R ratio substantially greater than one (generally from two to six, depending on the polymer). Moreover, the OTR and CO2TR values for such layers are inversely proportional to layer thickness, and are too low for most produce if the layers are sufficiently thick to provide adequate tear strength. Wall 120 includes suspension layer 200 of e.g. paper for strength, so gas permeable membrane 215 can be made as thin as required to produce desired OTR, CO2TR, and R values.

Polymeric layers commonly have R ratios that are undesirably high for some materials, which is to say that such layers are overly permeable to carbon dioxide relative to oxygen. One way to achieve a low R ratio is to use an acrylate coating polymer that contains a relatively large proportion of units derived from a cycloalkyl acrylate or methacrylate, e.g. at least 40%, which can be applied at a coating weight that results in an appropriate OTR. For example, a copolymer of n-hexyl acorylate and cyclohexylmethacrylate (CY6MA) containing 20-30% of CY6MA can produce a membrane with an R ration between 4 and 6, while a similar polymer containing 50% CY6MA applied at a coating weight giving the same OTR will generally give rise to a membrane having an R ratio of between 1.5 and 3. Other polymers that can be used to prepare membranes with low R ratios include dimethyl siloxanes, methacryloxypropyl tris (trimethylsiloxy) silane, and acrylate polymers containing units derived from a fluoroalkyl acrylate or methacrylate, e.g. acrylate polymers containing units derived from hexafluoroisopropylmethacrylate and/or hydroxyethyl methacrylate.

Polypropylene and polyethylene, commonly used in breathable packaging, typically exhibit R values of between four and six, meaning that the CO2TR is higher than the OTR. In contrast, polyvinyl acrylate has an R value significantly less than one. Sidewalls of materials with different R values can be used in the same package to achieve an combined R value between those of the sidewalls. In an embodiment of package 100 of FIG. 1, for example, sidewalls 120 and 125 can be or include respective films or laminates with relatively low and high R values so that bag 100 exhibits a combined R value between those of sidewalls 120 and 125. In some embodiments, for example, bag 100 exhibits are combined R values near one.

Bag 100 can be sealed around its contents to prevent produce from drying out. Walls 120 and 125 are selected so the overall bag 100 exhibits gas permeabilities that extend the shelf-life of its contents. Oxygen and carbon-dioxide are the primary gases of interest, and the combination of walls 120 and 125 is selected to optimize the overall permeabilities for oxygen and carbon dioxide. Walls 120 and 125 are opaque in this embodiment, but package clarity is desirably maintained because walls 110 and floor 115 can be of films optimized for visibility. In some embodiments bag 100 includes a pressure failure (rupture) point that allows for the produce to be cooked in a microwave while in bag 100.

In another embodiment the gas-transmission characteristics of walls 120 and 125 can be set using other techniques, such as via micro-perforation. For example, walls 120 and 125 can be made using a sheet of otherwise impermeable material laser perforated to include holes between ten and two hundred micrometers in diameter, with the number and size of the holes selected to achieve a desired permeability per unit area. Such sheets can be used to feed a box-pouch machine. Laser micro-perforation advantageously offers excellent control over the size and distribution of holes, and thus control over gas permeability, but requires expensive equipment. As in prior examples, the materials used for walls 120 and 125 can offer different permeabilities.

Figure 4:
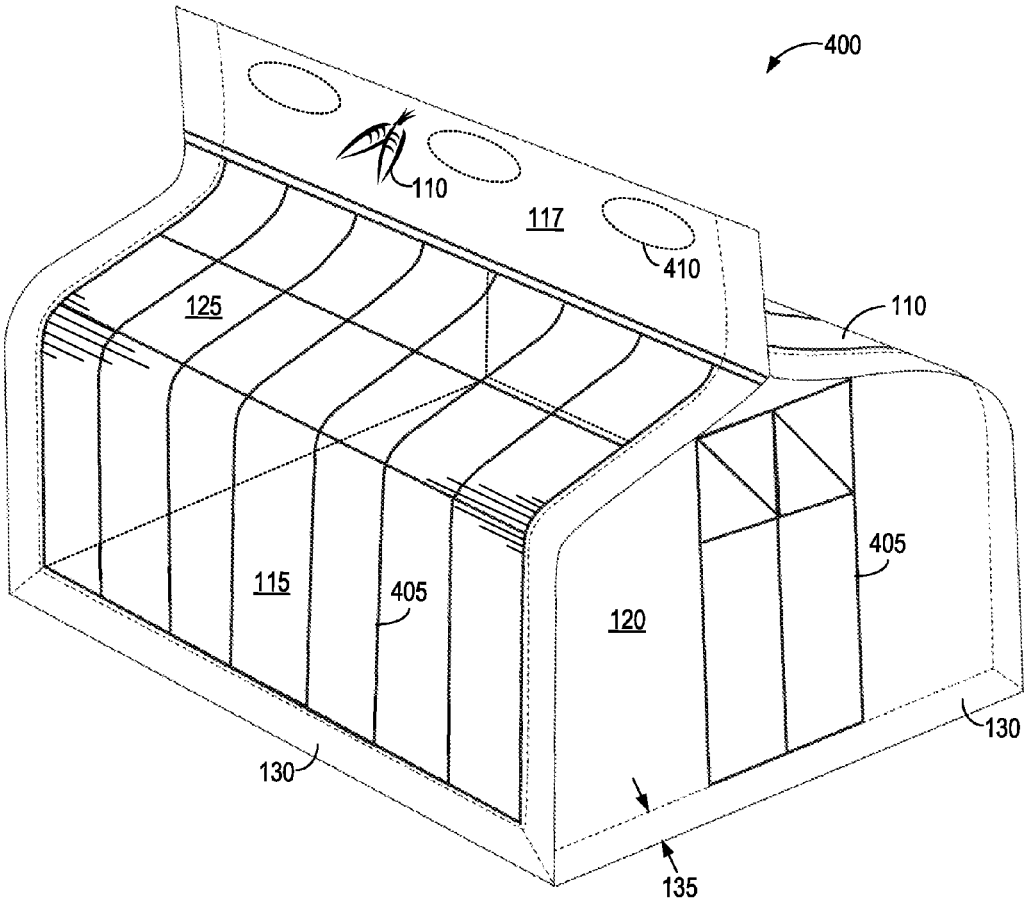
FIG. 4 details a bag 400 in accordance with another embodiment.

FIG. 4 details a bag 400 in accordance with another embodiment. Bag 400 and bag 100 of FIG. 1 have much in common, with like-identified elements being the same or similar. Clear walls 110 and opaque sidewall 120 and 125 include decorative features 405 evocative of a greenhouse. The shape of bag 400 and transparency of walls 110 are likewise evocative of a greenhouse, but bag 400 can be decorated and shaped differently in other embodiments. Holes 410 along top seal 117 make bag 400 easier to hold and hang, and can be incorporated into pressure failure points. Sidewalls 120 and 125 are selected to produce an overall gas permeability for bag 400 that is suitable for a particular cargo. An icon 420—carrots in this example—may be included along with other suitable labels so identify a type or class of suitable material.

Figure 5:
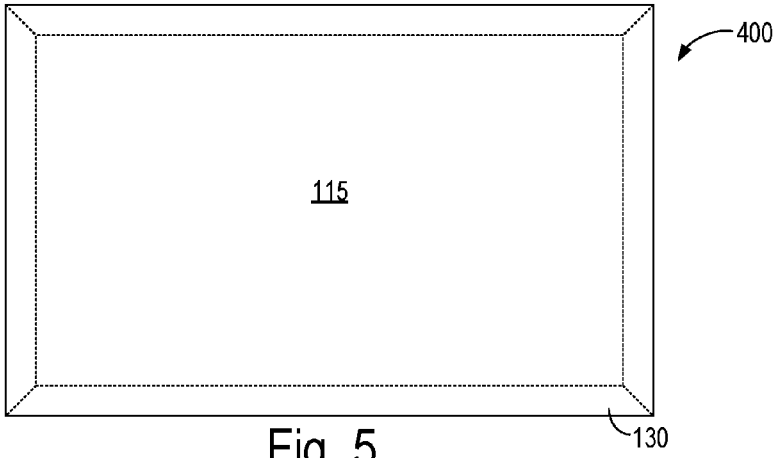
FIG. 5 is a bottom view of bags 100 and 400 of FIGS. 1 and 4, and is included to better illustrate seals 130 around the bottom periphery.

FIG. 5 is a bottom view of bags 100 and 400 of FIGS. 1 and 4, and is included to better illustrate seals 130 around the bottom periphery. Seals 130 that join opaque and clear materials are opaque to their edges in these examples.

While the present invention has been described in connection with specific embodiments, variations of these embodiments are also envisioned. These examples are in no way exhaustive, as many alternatives within the scope of the claims will be obvious to those of ordinary skill in the art. Therefore, the spirit and scope of the appended claims should not be limited to the foregoing description. For U.S. applications, only those claims specifically reciting "means for" or "step for" should be construed in the manner required under the sixth paragraph of 35 U.S.C. Section 112.

What is claimed is:

1. A gas-permeable bag for storing respiring biological materials, the bag comprising:

a gas-permeable first wall having:

a first film perforated with first holes to convey gases, the first holes having a first collective area;

a first gas-permeable layer having a first oxygen permeability (OTR), a first carbon dioxide permeability (CO2TR), and a first CO2TR/OTR permeability ratio (R1) at 20 degrees C.; and a first porous suspension layer;

a gas-permeable second wall having:

a second film perforated with second holes to convey the gases, the second holes having a second collective area;

a second gas-permeable layer having a second OTR greater than the first OTR, a second CO2TR, and a second permeability ratio R2 at 20 degrees C.; and a second porous suspension layer; and a transparent third wall of a material having a haze less than ten.

2. The bag of claim 1, wherein the first film comprises a seal layer bonded to the third wall over a seal area having a minimum seal dimension.

3. The bag of claim 2, wherein the holes are of a hole diameter less than the minimum seal dimension.

4. The bag of claim 2, wherein the second film comprises a second seal layer bonded to the third wall.

5. The bag of claim 1, wherein the second CO2TR is different from the first CO2TR.

6. The bag of claim 1, wherein the first porous suspension layer comprises paper.

7. The bag of claim 1, wherein the first gas-permeable layer comprises an adhesive.

8. The bag of claim 7, wherein the first gas-permeable layer is the adhesive.

9. The bag of claim 1, wherein the first gas-permeable layer is less than 0.5 mil thick.

10. The bag of claim 1, further comprising a transparent fourth wall, the first, second, third, and fourth walls to encompass the materials.

11. The bag of claim 1, further comprising a transparent fourth wall and a transparent fifth wall, the first, second, third, fourth and fifth walls to encompass the materials.

12. The bag of claim 1, wherein the first permeability ratio R1 is less than three.

13. The bag of claim 1, wherein the gas-permeable first wall exhibits a first wall OTR less than one and the gas-permeable second wall exhibits a second wall OTR greater than one.

14. The bag of claim 1, wherein the first porous suspension layer has an OTR greater than ten thousand.

15. The bag of claim 1, the transparent third wall having a haze of less than 15%.

16. The bag of claim 1, wherein at least one of the first wall and the second wall is opaque.

* * * * *